United States Patent [19]

de Lima Castro

[11] 4,001,957

[45] Jan. 11, 1977

[54] LABEL HOLDER FOR MAIL BAGS AND THE LIKE

[76] Inventor: Eduardo Neto de Lima Castro, Rua do Lavradio 162, Rio de Janeiro, Brazil

[22] Filed: Oct. 23, 1974

[21] Appl. No.: 517,350

[30] Foreign Application Priority Data

Oct. 24, 1973 Brazil ..... 8295

[52] U.S. Cl. ..... 40/10 R; 292/307 A

[51] Int. Cl.[2] ..... G09F 3/18

[58] Field of Search ..... 40/2, 20, 10, 2.2, 21; 292/307, 318, 322, 320; 24/30.5 R, 30.5 P, 30.5 T

[56] References Cited

UNITED STATES PATENTS

| | | | |
|---|---|---|---|
| 726,104 | 4/1903 | Schumann | 40/302 |
| 1,191,392 | 7/1916 | Brewster | 150/15 |
| 1,243,865 | 10/1917 | Orr | 24/30.5 R |
| 2,230,585 | 2/1941 | Canter | 40/302 |

FOREIGN PATENTS OR APPLICATIONS

| | | | |
|---|---|---|---|
| 343,828 | 11/1921 | Germany | 40/10 R |

*Primary Examiner*—Louis G. Mancene
*Assistant Examiner*—Wenceslao J. Contreras
*Attorney, Agent, or Firm*—Beveridge, DeGrandi, Kline & Lunsford

[57] ABSTRACT

A label holder for mail bags or the like comprises two parts, at least one of which is transparent, which can be superimposed with a label placed therebetween. Corresponding ends of the superimposed parts are provided with locking means for closing the holder, the first of the two parts being provided with an upstanding spool and the second of said parts including a cap portion for covering said spool upon closure of the label holder. The cap portion is formed with an orifice through which protrudes an upstanding lug formed on the upper surface of said spool and provided with groove means, at least partially, around its periphery. A string is attached to the part provided with the spool, the string being wrapped around the mail bag or the like, and then around the spool, whereupon the second part with the cap is closed to cover the spool. A plastic seal is then applied around said groove means in said lug so as to prevent the opening of the label holder. Preferably the label holder is integrally molded in translucent plastic, the two parts being joined by a plastic hinge.

17 Claims, 8 Drawing Figures

FIG. 5
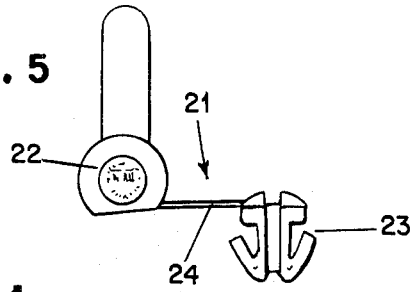
FIG. 1
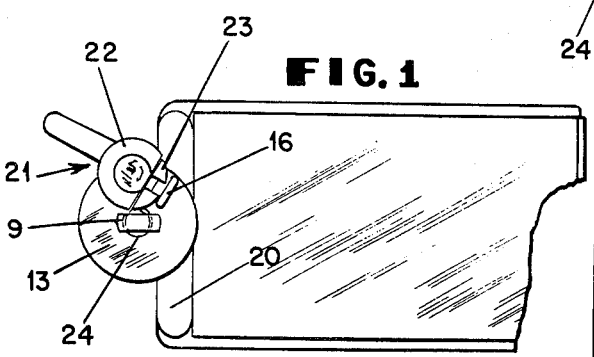
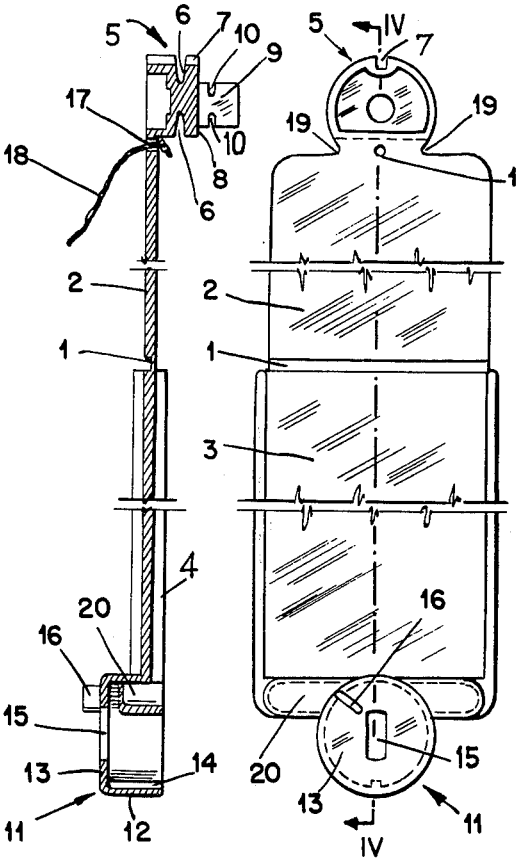
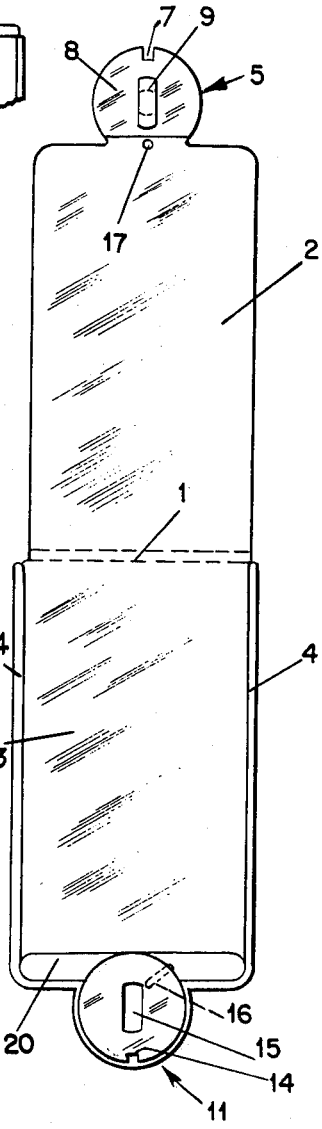
FIG. 4 FIG. 3 FIG. 2

LABEL HOLDER FOR MAIL BAGS AND THE LIKE

The present invention refers to a label-holder for mailbags, luggage and the like.

It is common practice to close and seal mailbags by tying the neck of the bag with a string which is then sealed, for security purposes, by a lead, metal or plastic seal after which a label is tied to the bag indicating the postal district or zone to which the contents of the bag have been addressed. Alternatively, the label is attached to the string closing the bag before the seal is applied. In both cases, however, when the bag reaches its destination and is opened, the string is cut and normally thrown away which represents a considerable waste of string.

In addition to the above the labels usually comprise thin cardboard or thick paper at one end of which a strengthened eye is fitted for the passage of the string. Such labels are not only relatively expensive but, being made of paper, are liable to be torn away accidentally from the mailbag during transport which may result in the bag going to the wrong destination or being delayed.

It is an object of the present invention to provide a special label-holder which may be used many times, protects the label, saves string, uses a cheaper label and which is closed by the same security seal as that used to seal the mailbag or other luggage in question.

According to the present invention the novel label-holder comprises a first part cooperable with a second part for holding a label, said first part having integrally formed therewith a fixed spool having a projection at one end thereof, said projection having formed therein slot means around at least a part of its sidewall periphery, said second part including integral therewith a cap past having an inner surface corresponding substantially to the outer surface of said spool and having an upper surface formed with a through aperture whose dimensions are substantially the same as the greatest transverse dimensions of said projection, means being provided for fixing a string or the like to the first said part in the region of the spool.

Preferably said first and second parts are rectangular and hingedly joined together at one end, opposite to the respective ends of said two parts to which the spool and cap are fixed, one of said parts having depending flanges along its other two sides for receiving snugly therebetween the other of said parts.

When the label-holder of the invention is to be used, a string is first attached to the first of said parts and the string is then wound at the same time tightly around the neck of the mailbag and the label holder in the region of the junction between the first part and the spool, after which it is wrapped several times around the spool until there is no slippage. A simple rectangular label without any eye or fixing means is then placed between the two parts which are placed together with the cap fitting over the spool with the projection on the latter passing through the aperture in the former. At this stage the label holder is provisionally closed after which a special seal having a short thread joining male and female seal parts is fixed around the said projection with the thread held in said groove means in the projection. The seal then serves both to seal the bag and the label-holder.

When the seal is broken, it will be appreciated that the holder can be opened and the string simply unwound from the spool and from the neck of the sack. The label is removed and the label-holder and the string are in perfect condition for re-use.

The invention will now be described in greater detail, by way of example, with reference to the accompanying drawings, in which:

FIG. 1 is a plan view of the novel label-holder closed and sealed;

FIG. 2 is a plan view of the label-holder when open;

FIG. 3 is a bottom view of the label-holder when open;

FIG. 4 is a cross section taken along line IV—IV of FIG. 3; and

FIG. 5 is a perspective view of a security seal used in closing the label-holder, as shown in FIG. 1.

Figure 6:
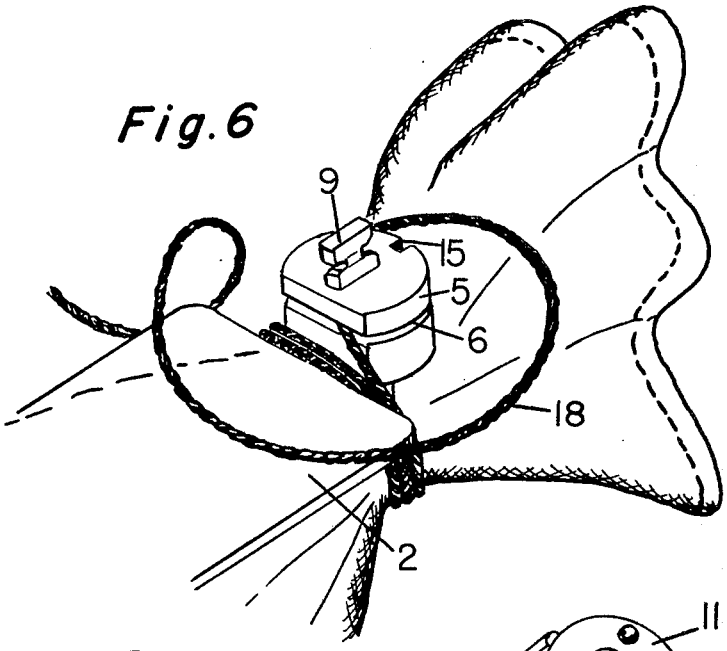
Figure 7:
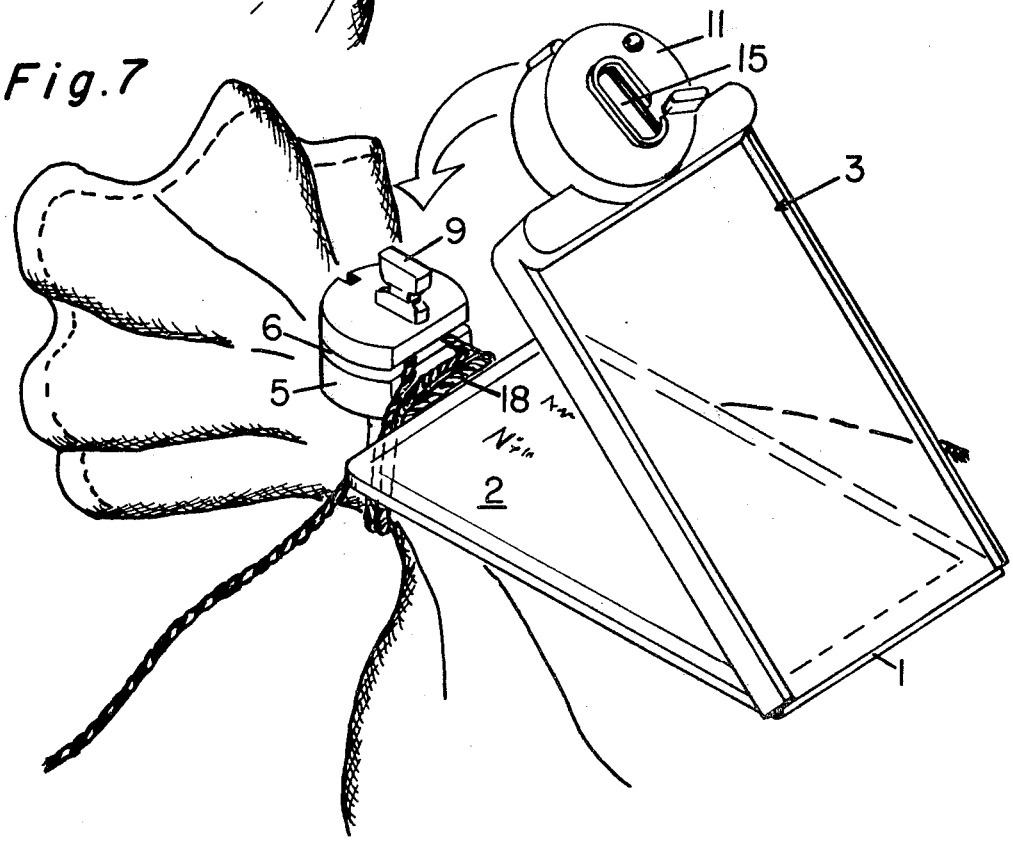
Figure 8:
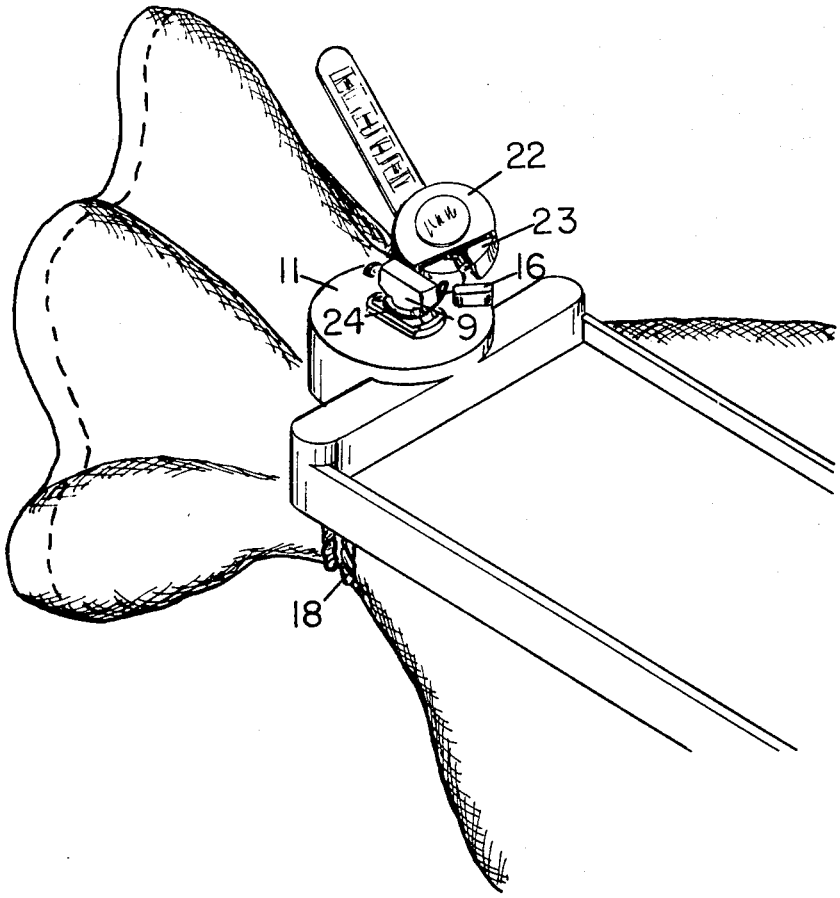

FIGS. 6–8 show the various stages of attachment of the device of the invention to the neck of a mail bag. FIG. 6 shows the initial stage when the string is wrapped in the groove of the spool. FIG. 7 shows movement of the device to its closed position; and, FIG. 8 shows the final stage when the label holder is kept in its closed position by a seal.

Referring now to the drawings, the label-holder comprises two principal rectangular transparent or translucent plastic parts 2 and 3 integrally joined by a plastic hinge 1, in other words parts 2 and 3 are a single element divided by a narrow thin section 1. The lower or base part 2 is planar and of the same size as upper or cover part 3 except that the latter has a dependent flange 4 along its two opposite sides so that when a label is placed therein and the two parts are folded and fitted together, the label will not become dislodged laterally.

The base part 2 is provided at one end opposite the hinge line 1 with an integrally molded spool 5. This is best seen in FIGS. 2 and 4. The spool 5 has a circular slot 6 around which can be wound a string or cord which is used for closing a mailbag or the like. The spool 5 is not completely circular but rather in the form of a segment of a circle, having an included angle greater than 180° and, in the embodiment shown, about 270°. This characteristic is not essential to the invention but is merely more practical for both manufacturing and aesthetic reasons. It is also one way of providing space for the passage of the string before and after being passed around the spool 5, as will be explained later. The generally circular shape of the spool is also not essential since it could be of any other adequate cross-sectional form, square for instance.

As can be seen from the drawings, the spool 5 has a vertical groove or slot 7 cut in the side wall thereof and parallel to the axis of the spool, the slot being positioned for manufacturing convenience diametrically opposite the base part 2.

The upper flat surface 8 of the spool 5 is provided with an upstanding rectangular projection 9 provided with two transverse slots 10 across the shorter ends thereof.

The upper or cover part 3 of the label-holder has molded therewith at its end opposite the hinge line 1 a circular cap 11 which is adapted to fit snugly over the spool 5 when the label-holder is closed. The circular side wall 12 of the cap 11 extends sufficiently away from its upper surface 13 comfortably to pass beyond the string receiving groove 6 of the spool 5 when closed. In correspondence with vertical slot 7 of spool 5, there is a vertical rib 14 on the inner surface of the cap sidewall 12 which fits snugly into said slot 7. The upper surface 13 of cap 11 is formed with a rectangular opening 15 which permits passage of the spool projection 9 so that when the label-holder is closed with the cap covering the spool and the projection 9 passing through opening 15, said transverse slots 10 in the projection are located approximately at the level of the surface 13 of cap 11 surrounding said opening 15. Approximately opposite one corner of the rectangular opening 15 and extending radial of the cap surface 13 is an upstanding stop 16 whose purpose will be described later.

The base part 2 of the label-holder is also formed, in the region of the junction with spool 5, with a small through hole 17 through which a length of string (18) is passed and knotted (see FIG. 4). At either side of the hole 17, the junction between base part 2 and spool 5 is necked at 19, 19.

The upper or cover part 3 of the label-holder in the region of the junction with the cap 11 is molded with a hollow upstanding portion 20 defining an approximately rectangular cavity giving access, when the label-holder is closed, to the spool 5 in the region where the spool is sectioned as mentioned earlier, with a view to giving room for the string.

FIG. 5 shows a seal (21) to be used with the label-holder but, being known, will only be described as far as is necessary for its application to the present invention. The seal 21 comprises an outer capsule 22 and an insert member 23 which, when inserted in capsule 22, cannot be removed therefrom. The two parts 22 and 23 are joined by a short thread 24 of such a length that when the label-holder is closed, the seal can be applied around the projection 9 with the thread 24 caught in the two slots 10, at which time the label-holder cannot be opened since the presence of the thread 24 wrapped around the projection 9 (and, of course, the presence of the seal itself) does not permit the projection 9 to be removed from the opening 15 in cap 11.

The application of the label-holder to seal and address a mailbag will now be described. First of all the string 18, one end of which is knotted to fix it to base part 2, is wound several times tightly around the closed neck of the bag and, at the same time, the necked region 19, 19 of base part 2 bringing the label-holder tightly against the neck with spool 5 facing outwardly, after which the string is wrapped several times around spool 5 in groove 6 as shown in FIG. 6, until such time that the string can be released without slippage.

Next, the correctly addressed label is placed between parts 2 and 3 which are closed together about the hinge line 1 as shown in FIG. 7, until the cap 11 fits snugly over spool 5 with projection 9 passing through opening 15 and the string wrapped around the neck region 19, 19 being accommodated by the cavity under hollow projection 20. The free end of the string can hang from the label-holder, passing through the space defined by hollow projection 20 and the sectioned part of the spool, to which mention has already been made. The string 18 may then be cut or a reasonable length left dangling.

To seal the label-holder, the end surface of the insert member 23 of seal 21 is placed against radial stop 16 and the capsule 22 is passed between stop 22 and projection 9 and around the latter so that the thread 24 becomes engaged in slots 10 after which the seal is closed as shown in FIG. 8, the stop 16 serving as a pressure surface during closure and the thread 24 having to be stretched somewhat to achieve closure and to ensure that the seal cannot be liberated from projection 9 without first breaking the thread. The label-holder and the mailbag are now sealed, see FIG. 1. The seal is preferably applied using a special tool (not described).

It has been found impossible to remove the string without breaking the seal or damaging the label-holder in an easily visible manner. It might be imagined that it would be possible, although with no little effort, to unwind the string 18 from spool 5 by pulling it downwardly and around the reel to force it progressively between the outer side surface of the spool and the inner side surface of the cap 11, passing the string through the cavity formed under portion 20 at the completion of each turn. This, however, is positively prevented by the cooperation of rib 14 and slot 7, the only manner of getting string past this obstruction being the clearly visible violation of the cap 11. Moreover, and even if it were possible to open the mailbag in this manner, it would be entirely impossible to re-wind the string on fixed spool 5 without removing the seal itself.

On arrival at the destination, the seal can be flipped upwardly, breaking thread 23, whereupon the label-holder can be opened and the string unwound. No cutting of the string is necessary and the label-holder with the string still attached is once more ready for use. Experience has shown that the same string can be used on an average of one thousand times before it has to be replaced. This represents a considerably economy.

The main advantages of the invention are:

a. there is a considerable economy of string;
b. cheaper labels can be used (at least one-third of the price of those presently being used);
c. the absolute facility in the combined closing and sealing of a mailbag together with the application of the label. The closing and sealing operation is very much quicker and simpler than conventional methods;
d. the label is protected, cannot fall and cannot be tampered with during transport without breaking the seal.

We claim:

1. A label holder attachable by a string or the like to mailbags, luggage or the like comprising a first part cooperable with a second part for holding a label therebetween, said first part having integrally formed at one end thereof a fixed spool having a recess within which a portion of said string or the like may be wound, said second part including integrally therewith a cap part having an inner surface corresponding in shape substantially to the outer surface of said spool for closure over the latter to confine a string positioned within said recess, said first and second parts including means permitting them to be sealed together with said spool received within said cap part when said first part and said second part are closed for holding said label therebetween, means being provided for permitting the string or the like to be fixed to said first part in the region of said spool, said cap part having an inner side wall surface provided with a rib extending generally parallel to the axis of said cap, and said spool has an outer side surface formed with a slot adapted to receive said rib.

2. A label holder attachable by a string or the like to mailbags, luggage or the like comprising a first part cooperable with a second part for holding a label therebetween, said first part having integrally formed at one end thereof a fixed spool having a recess within which a portion of said string or the like may be wound, said second part including integrally therewith a cap part having an inner surface corresponding in shape substantially to the outer surface of said spool for closure over the latter to confine a string positioned within said recess, said first and second parts including means permitting them to be sealed together with said spool received within said cap part when said first part and said second part are closed for holding said label therebetween, means being provided for permitting the string or the like to be fixed to said first part in the region of said spool, said means permitting sealing comprise a projection at one end of said fixed spool, said projection having formed therein slot means around at least a part of its side wall periphery, a through opening formed through the upper surface of the said cap part for receiving said projection, said through opening having dimensions substantially the same as the greatest transverse dimensions of said projection.

3. Label-holder according to claim 2 in which said upper surface of said cap is provided with an upstanding stop.

4. Label-holder according to claim 2 in which said projection is generally rectangular and said slot means comprise two transverse slots across the shorter sides of said rectangle.

5. A label holder attachable by a string or the like to mailbags, luggage or the like comprising a first part cooperable with a second part for holding a label therebetween, said first part having integrally formed at one end thereof a fixed spool having a recess within which a portion of said string or the like may be wound, said second part including integrally therewith a cap part having an inner surface corresponding in shape substantially to the outer surface of said spool for closure over the latter to confine a string positioned within said recess, said first and second parts including means permitting them to be sealed together with said spool received within said cap part when said first part and said second part are closed for holding said label therebetween, means being provided for permitting the string or the like to be fixed to said first part in the region of said spool, said spool having a cross-section in the shape of a segment of a circle whose included angle is greater than 180°.

6. Label-holder according to claim 3 in which said projection and said through opening are generally rectangular, said slot means comprise two tranverse slots across the shorter side of the rectangle and said upper surface of said cap is provided with an upstanding stop located in the region of one corner of said rectangular opening.

7. Label-holder according to claim 5 in which the junction between said first part and said spool is necked and the junction between said cap part and said second part is molded with a protuberance defining a cavity facing said first mentioned junction.

8. Label holder according to claim 2 in which said spool has a cross-section in the shape of a segment of a circle whose included angle is greater than 180°.

9. Label holder according to claim 8 in which the junction between said first part and said spool is necked and the junction between said cap part and said second part is molded with a protuberance defining a cavity facing said first mentioned junction.

10. Label holder according to claim 2 in which said first part and said second part comprise a single rectangular element divided into two parts by a narrow, thin plastic hinge.

11. Label holder according to claim 2 in which said first and second parts are substantially rectangular and one of said parts is provided with lateral upstanding flanges between which said other part fits when closing said label holder.

12. A label holder attachable by a string or the like to mailbags, luggage or the like comprising a first part cooperable with a second part for holding a label therebetween, said first part having integrally formed at one end thereof a fixed spool having a radially outer axially extending peripheral surface formed with a peripheral groove intermediate the axial extension of said surface and around and within which a portion of said string or the like may be wound, said second part including integrally therewith a cap part having an inner surface corresponding in shape substantially to the outer surface of said spool for closure over the latter to confine a string positioned within said recess, said first and second parts including means permitting them to be sealed together with said spool received within said cap part when said first part and said second part are closed for holding said label therebetween, means being provided for permitting the string or the like to be fixed to said first part in the region of said spool.

13. Label-holder according to claim 12 in which said first part and said second part comprise a single rectangular element divided into two parts by a narrow, thin plastic hinge.

14. Label-holder according to claim 12 in which said first and second parts are substantially rectangular and one of said parts is provided with lateral upstanding flanges between which said other part fits when closing said label-holder.

15. Mailbag or the like sealed with a label-holder, comprising a. a mailbag or the like;

b. a label-holder comprising a first part and a second part between which a label may be placed, said first part including integral therewith a fixed spool having a projection at one end thereof, said projection having formed therein slot means around at least a part of its side wall periphery, said second part including integral therewith a cap part having an inner surface corresponding substantially to the outer surface of said spool and having an upper surface formed with a through opening whose dimensions are substantially the same as the greatest transverse dimensions of said projection;

c. string means or the like fixed to said first part of said label holder and being wrapped tightly around the neck of said mailbag or the like and then wrapped several times around said spool;

d. a security seal comprising a male part and a female part insertable in said male part for closing said seal, said male part and said female part being joined by a thread which, when stretched and with the seal closed is of sufficient length just to pass around said projection in cooperation with said slot means; and e. a label placed between said first and second parts, said second part with said cap portion being closed over said first part and said spool whereby said projection passes through said opening in said cap upper surface, said seal being positioned and closed on said cap upper surface with said thread passing around said projection in cooperation with said slot means.

16. Label-holder according to claim 15, in which the junction between said first part of said spool is laterally necked, said string means being passed around said necked junction at the same time as it is wrapped around said neck of said mailbag or the like.

17. The label holder of claim 12 in combination with a mailbag and a string means or the like wrapped tightly around the neck of said mailbag, said string also being wrapped several times about said peripheral groove in said spool.

* * * * *